United States Patent [19]

Carlsson et al.

[11] 4,062,611

[45] Dec. 13, 1977

[54] CONNECTOR SYSTEM FOR A RACE EQUIPMENT

[75] Inventors: Jan-Olov Carlsson, Tyreso; Ernst Elof Åke Johansson, Bandhagen; Lars Christer Pahlén, Varby, all of Sweden

[73] Assignee: Telefonaktiebolaget L M Ericsson, Stockholm, Sweden

[21] Appl. No.: 724,648

[22] Filed: Sept. 20, 1976

[30] Foreign Application Priority Data

Oct. 2, 1975 Sweden ..... 7511089

[51] Int. Cl.[2] ..... H05K 1/14

[52] U.S. Cl. ..... 339/17 M; 339/45 M; 339/198 R; 361/428

[58] Field of Search ..... 179/98; 317/99, 122; 339/18, 17 L, 17 LM, 17 M, 45, 186 M, 198 R, 198 CC, 198 GA, 198 H, 198 S, 198 P; 361/428

[56] References Cited

U.S. PATENT DOCUMENTS

| | | | |
|---|---|---|---|
| 3,371,307 | 2/1968 | Baeholm | 339/17 LM |
| 3,375,406 | 3/1968 | Alden | 317/122 |
| 3,399,374 | 8/1968 | Pauza | 339/184 M |
| 3,560,632 | 2/1971 | Wallace | 339/198 |

*Primary Examiner*—Roy Lake
*Assistant Examiner*—Mark S. Bicks
*Attorney, Agent, or Firm*—Hane, Roberts, Spiecens & Cohen

[57] ABSTRACT

In a rack mounted electrical equipment modules, for example, printed circuit cards are plugged into connectors arranged on the back plate of a shelf. Several shelves are mounted in a rack and are interconnected by cables mounted in the rack. In order to dispense with the connectors normally used to interconnect the shelves with the cables the back plate connectors are provided with a fixed part and a detachable part. The fixed part is used for the internal wiring of the shelf and the detachable part is connected to the cable. When the shelf is mounted in the rack the detachable part is snapped into the connector.

4 Claims, 3 Drawing Figures

CONNECTOR SYSTEM FOR A RACE EQUIPMENT

The present invention relates to a connector system for a rack mounted electrical equipment for facilitating the extension of present equipment, while reducing the number of connector devices.

Complicated electrical equipment, for example, equipments for process control and telecommunication, is often designed according to a hierarchical system. On the lowest level, which can be designed a module, there is room for a limited unit, for example, an amplifier. The module is often built on a circuit card. A number of modules are in their turn mounted together in a rack shelf, which then often comprises all modules in a functional unit, for example, all amplifiers within a group of connections. These rack shelves are located, in their turn, in a rack, which alone, or together with other racks form a complete equipment.

The different levels in such a hierarchy are interconnected by connectors and/or by wiring. The circuit cards are, for example, provided with edge contacts, which are pluged into a connector mounted in the rack shelf. The connectors for all the circuit cards in the rack, are mounted on a plate which forms the so called back panel of the rack shelf. Connections between the circuit cards in the same rack are made by means of connection wires, which are drawn between contact pins on the connectors. Connections between the rack shelves in the same rack and between different racks are made by wiring which can be carried out differently.

It often occurs that all the rack shelves are not initally mounted, but are added in connection with a later extension. How such an extension should be carried out, and how an equipment mounted later should be connected to present equipment, must then be planned. Of different reasons it is, if possible, desirable to install all rack harness which is needed for a completely filled rack from the beginning.

It is known, when mounting a new rack shelf, to connect the existing rack harness to the contact pins of the shelf back panel by soldering or wire wrapping, but this is unpractical for several reasons. There is often very little space and, if it is a question of connection high up or deep down in a rack, the installer will have an uncomfortable working position. Soldering in a rack always involves a risk of interruptions of the service. There is also a great risk of faulty connections and the testing becomes more difficult.

The most common way, according to a known technique, is to connect rack shelves to the rack harness, by means of special connectors, one half of which is in the rack, while the other half is in the rack shelf. According to one variation, the conductors which shall connect the separate connectors on a rack shelf with other shelves and/or racks are cabled together and are connected to one or several connectors which fit corresponding connectors in the rack. According to another known variation the rack and the rack shelves are provided with fixed connectors intended for the interconnection, which is carried out by means of loose cables, provided with connectors at both ends.

Both of these variations have the drawback that a connection between circuits on two different shelves must pass at least four contact interfaces. As the connectors form a considerable source of errors in electrical equipments and furthermore, are expensive, it is important to reduce the number of connectors. The system with loose connection cables also involves the risk that the cables are mixed up, if it is not possible to make them identical. These drawbacks can be avoided, according to the invention, by means of a rack mounted electrical equipment with modules, for example, circuit cards arranged on rack shelves which modules are provided with contacts intended for a co-operation with the connectors which are fixed on the rack shelf, and the characteristics of which appear from the appended claims.

The invention will be further described in connection with the appended drawings where:

FIG. 1 schematically shows a part of a rack with a mounted rack shelf;

Figure 1:
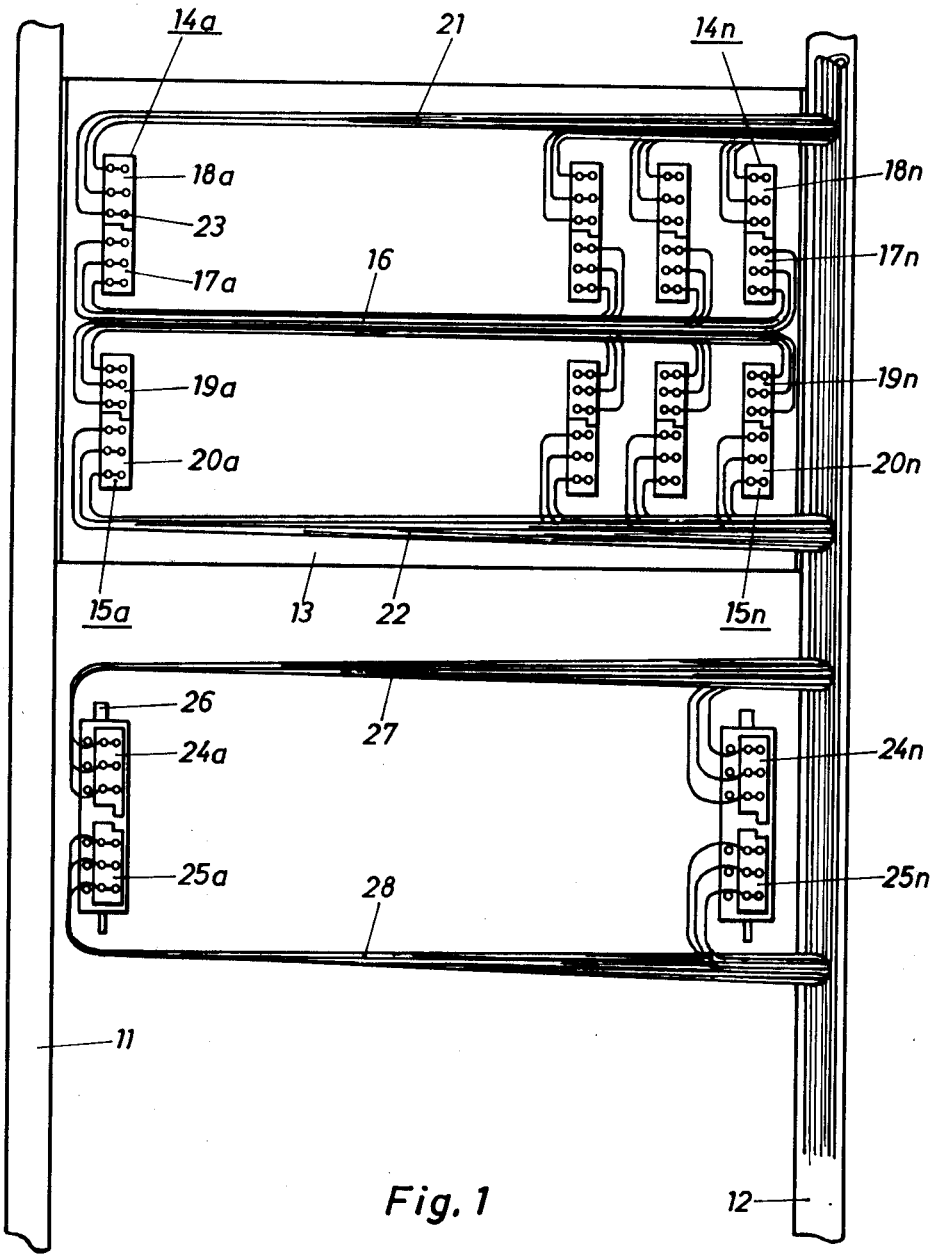

In FIG. 1, 11 and 12 designate side members in a rack which is intended for several rack shelves. A rack shelf is mounted in a rack and its back panel is designated 13. In the back panel 13, there are two rows of connectors 14*a*–14*n* and 15*a*–15*n*. On the not shown front side of the rack shelf, a number of circuit cards are connected to the connectors. The connectors 14*a*–14*n* 15*a*–15*n* have a fixed part 17*a*–17*n* and 19*a*–19*n* and a detachable part 18*a*–18*n*, 20*a*–20*n*.

The contact pins 23 on the fixed part 17*a*–*n*, 19*a*–*n* are used for all connections within the shelf which is schematically indicated by means of the cable harness 16. These connections are made when mounting the shelf in a factory. The detachable part of the connectors are not mounted in the connectors when delivering the shelf, but is placed in the connector housing only after the shelf is placed in the rack. The detachable parts 18*a*–18*n*, 20*a*–20*n* are connected to a cable branch 21, 22 of the rack harness.

The lower part of FIG. 1, shows two cable branches 27, 28 with connected connector parts 24*a*–24*n*, 25*a*–25*n* after the rack harness has been carried out, but before the appertaining rack shelf has been mounted. The parts of the connectors 24*a*–24*n*, 25*a*–25*n* hang in the cable branches 27, 28 and to protect them, they have been provided with caps 26, of that kind, which will be further described in FIG. 3. The purpose of the caps is to facilitate the wiring work.

Figure 2:
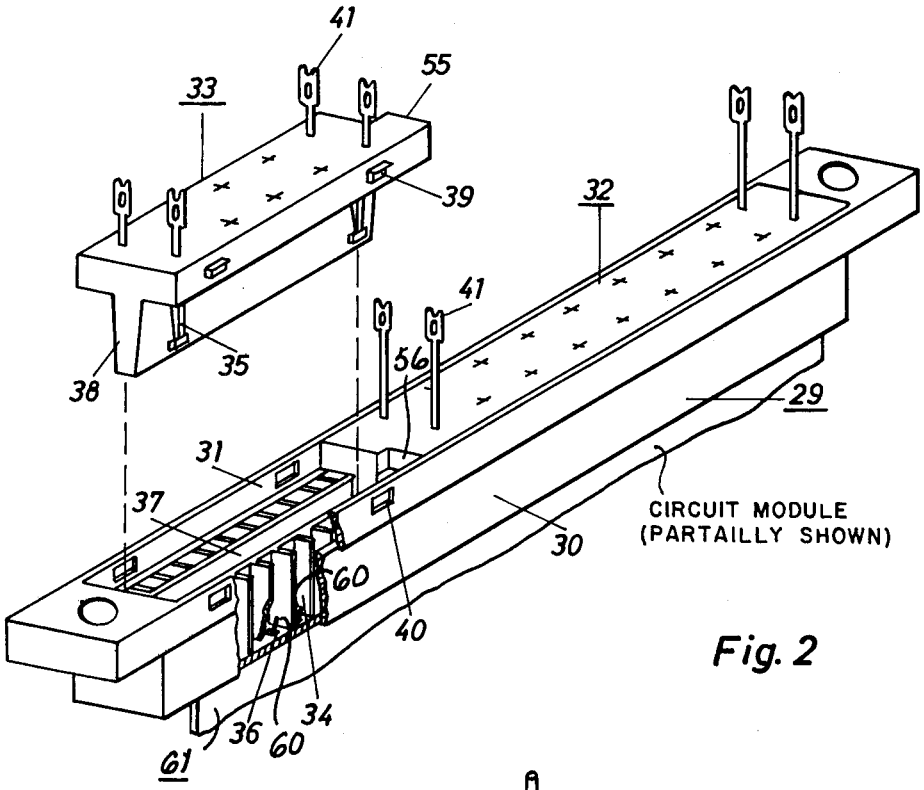
FIG. 2 shows a connector with detachable contact carrier.

In FIG. 2, a connector 29 of a socket type is shown, intended for co-operation with a plug device such as pins 60 on a circuit card 61. The connector 29 is any one of the connectors 14 of FIG. 1. The connector 29 consists of a case 30 with a well 31 in which contact carriers 32, 33 are mounted. In the bottom of the well 31, there are two lines of boxes 34, into which the contact elements 35 are guided. In the bottom of these boxes 34, there are openings 36 for the terminal pins 60 of the plug device of circuit card 61. Between the lines of the boxes 34, there is a guide groove 37 which co-operates with a tongue 38 on the contact carrier 33. The contact carrier 33 also is provided with a number of detents 39, which are arranged to snap into corresponding openings 40 in the connector housing 30. The contacts 35 of the contact carrier are as usual provided with terminal pins 41 for wire wrapping or soldering.

The contact carrier 32 which is any one of the fixed parts 17 or 19 of FIG. 1. is fixed to the housing 31 when the connector 29 is mounted on the back panel 13 of the rack shelf. However, the contact carrier 33 which is any one of the detachable parts 18, 20, 24 or 25 of FIG. 1. is delivered loose. Naturally, the contact carrier 32 can be constructed in the same way as the contact carrier 33, which is to be preferred from the point of view of easy production.

Figure 3:
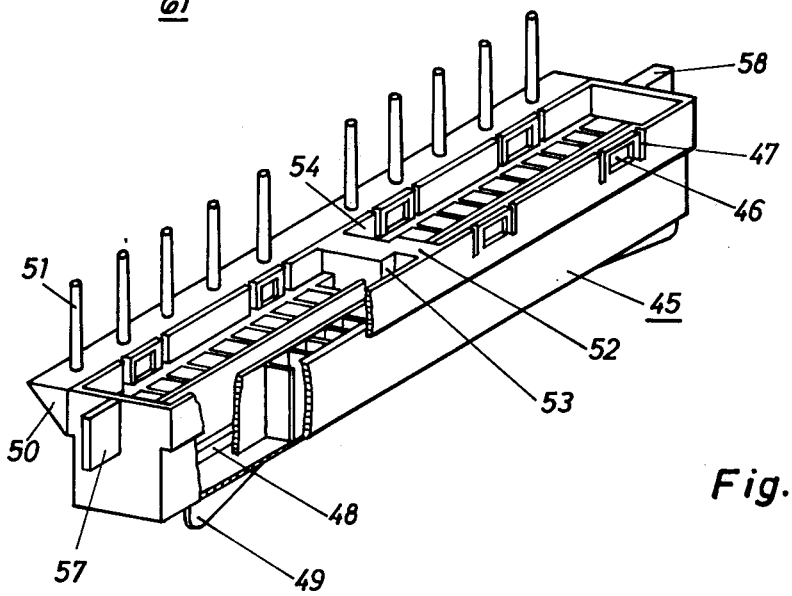
FIG. 3 shows a sleeve suitable for the contact carrier.

In order to protect the damageable contacts 35 during transport and handling, it is convenient to keep the contact carriers in holders of the kind shown in FIG. 3. Such a holder 45 which is any one of the caps 26 of FIG. 1. is, in principle designed in the same way as the case 30. However, the wall around the openings 46 which are intended for the lock detents 39 is provided with slots 47 in order to increase the resiliency so the contact carrier can be easily inserted and removed from the holder.

In the bottom of the guide grooves corresponding to the tongue 38, there are slots 48, into which spring loaded ejectors 49 can be pressed, in order to loosen the contact carrier 33 from the holder 45.

The holder 45 shown in FIG. 3 is intended for two loose contact carriers 33 (24 or 25 in the bottom of FIG. 1 before installation) each of which shall be plugged into one of two different rows of connectors in a rack shelf, of that kind which is shown in FIG. 1. As elements 18 or 20 in the top of FIG. 2 after installation adjacent contact carriers are located in a common holder until the mounting, there is no risk that the contact carriers, which belong to different rack shelves get mixed up. Naturally, it is possible to make the holder for an arbitrary number of contact carriers. In order to avoid the possibility that the contact carriers for the lower and the upper line of connectors are interchanged, a partition wall 52, which separates the two spaces of the contact holders, is provided with notches 53, 54 of different size. These match the corresponding projection 55 on the different contact carriers. Also the fixed contact carrier 32 in the connector 29 is naturally provided with corresponding key notch 56.

When forming the cable harness, the detachable contact carriers 33 which are attached to their holder and belong to a certain rack shelf, are suitably located in a fixture which corresponds to the back panel 13. The fixture is located on the place for the rack shelf in the rack. In order to avoid mistakes of the contact carriers, the holder is provided with guides of different width 57, 58 which shall fit into corresponding slots in the fixture. Furthermore, the holder 45 is provided with a bracket 50 with a number of pins 51 which serve as wire guides when the cable harness is formed.

When all connections have been made and the cable harnesses, for example, 27, 28 are formed, the fixture is removed and the contact carriers with appertaining holders hang loose in the cable harness until the rack shelf is to be mounted. Then, the contact carriers are detached from the holders, in proper order, and are put into the free space 31 in the appertaining connector housing, until the detents 39 snap into the openings 40. The equipment is thereby ready for use.

Thus, it is possible to make the wiring immediately operative for a complete rack and when extending it is only necessary to plug in new rack shelves according to need. Thus, the advantages of known systems are obtained where the rack shelves and the rack harness are connected by means of extra connectors However, there are no drawbacks such as higher costs or lower reliability which characterize such known systems.

We claim:

1. A rack mounted electrical system comprising:

a rack; a plurality of rack shelves on said rack; a plurality of connector cases mounted on each of said rack shelves, one side of each of said connector cases being provided with terminal-receiving openings, the other side of each of said connector cases being provided with a well which communicates with said terminal-receiving openings; a plurality of circuit modules each having a plurality of extending terminals, each of said circuit modules being connected to one of said connector cases by its extending terminals fitted into the terminal-receiving openings of the associated connector case; a plurality of first connector carriers, each of said first connector carriers having a plurality of connectors mounted therein with each one of said connectors having at one end a wire-accepting terminal and at the other end a contactor, each of said first connector carriers being fixed in a first portion of the well of one of said connector cases with the contactors thereof in contact with the extending terminals of the circuit modules connected to the connector case; a plurality of first multiwire cables, each of said first multiwire cables interconnecting in a predetermined manner the wire-accepting terminals of the first connector carriers associated with a rack shelf; a plurality of second connector carriers similar to said first connector carriers; and a multiwire cable harness means mounted on said rack for providing circuit connections between said rack shelves, the wires of said cable harness means interconnecting in a predetermined manner the wire-accepting terminals of the second connector carriers; and each of said second connector carriers being removably inserted in a second portion of the well of one of said connector cases with the contactors thereof in contact with the extending terminals of the circuit module connected to the connector case.

2. The system of claim 1 further comprising a removable holder means for protecting one of said second connector carriers until insertion into the well of a connector case.

3. The system of claim 2 wherein said holder means is provided with an ejector means for releasing said second connector carrier.

4. The system of claim 1 wherein said second connector carriers are provided with key means for preventing improper insertion of the second connector carriers into the wells of said connector cases.

* * * * *